United States Patent [19]

van Wersch et al.

[11] 4,442,560

[45] Apr. 17, 1984

[54] METHOD FOR CONTINUOUSLY FINISHING AND/OR DYEING PLANAR TEXTILE STRUCTURES

[75] Inventors: Kurt van Wersch, Wegberg; Manfred Pabst, Cologne, both of Fed. Rep. of Germany

[73] Assignee: A. Monforts, Monchen-Gladbach, Fed. Rep. of Germany

[21] Appl. No.: 192,303

[22] Filed: Sep. 30, 1980

[30] Foreign Application Priority Data

Oct. 1, 1979 [DE] Fed. Rep. of Germany ..... 2939796

[51] Int. Cl.[3] ..... D06B 5/08

[52] U.S. Cl. ..... 8/151; 68/204; 118/50; 118/257; 427/350; 427/373

[58] Field of Search ..... 8/149.1, 151, 477; 68/DIG. 5, 8, 20, 204, 205 R; 427/350, 373; 118/50, 257

[56] References Cited

U.S. PATENT DOCUMENTS 3,042,573 7/1962 Roberts ..... 8/477 X 3,768,280 10/1973 Kannegiesser et al. ..... 118/257 X

*Primary Examiner*—Philip R. Coe

*Attorney, Agent, or Firm*—Herbert L. Lerner; Laurence A. Greenberg

[57] ABSTRACT

Method of continuously treating planar textile structures by applying thereto a treatment medium in the form of foam, which includes subsequently applying underpressure to the planar textile structures at a magnitude at which the foam is completely destroyed without any appreciable flow through the material of the planar textile structures.

2 Claims, 2 Drawing Figures

METHOD FOR CONTINUOUSLY FINISHING AND/OR DYEING PLANAR TEXTILE STRUCTURES

Figure 1:
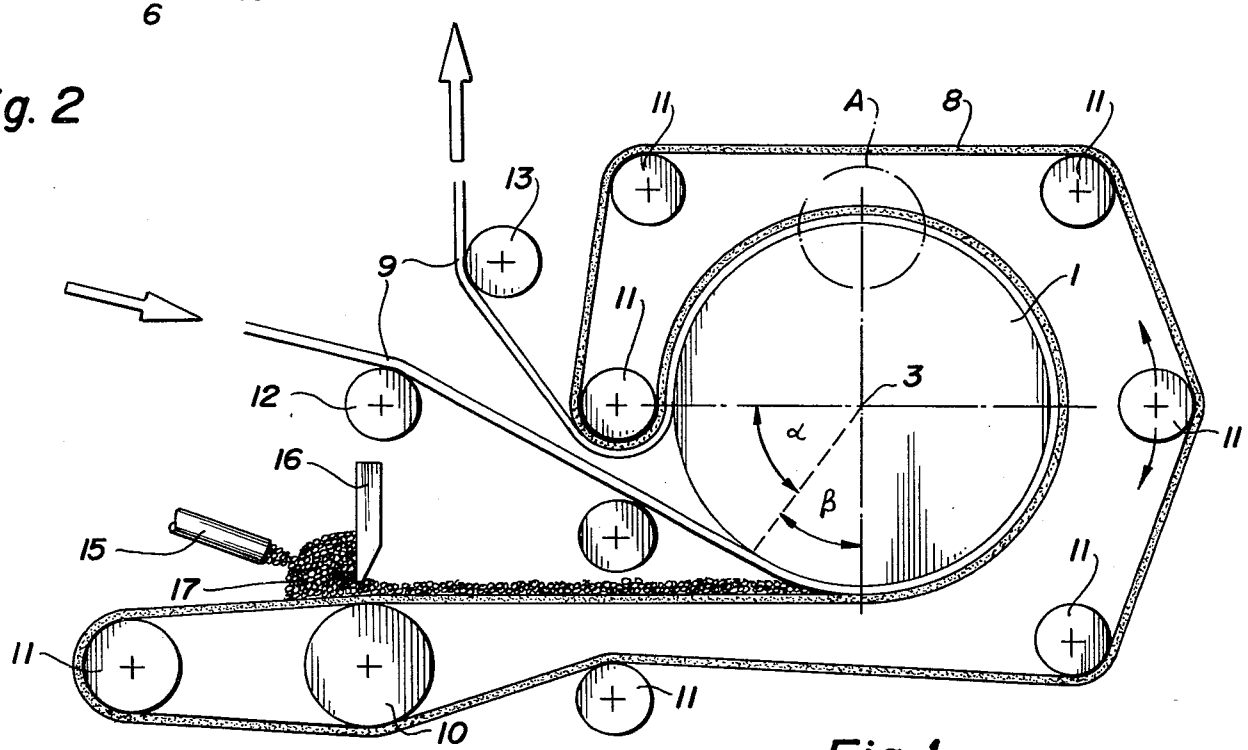

The invention relates to a method for continuously finishing and/or dyeing planar textile structures by applying the respective treatment liquor in foam form, the planar structure being subsequently subjected to underpressure. Depending upon the type of treatment medium, the application and destruction of the foam can be followed by a fixing of the treaatment medium on the textile material.

A method of the aforementioned type for continuously treating flat textile material of synthetic or natural fibers or of mutual mixtures of such fibers, using a liquor containing at least one treatment medium suitable for the respective fiber type and, if desired or necessary, chemicals required for the fixation thereof as well as surface-active substances which are foamed and applied as a foam to the textile material in the form of a layer, is already known from U.S. Pat. No. 3,084,661. Thereafter, the foamed treatment medium is drawing into the textile material by suction exerted on the rear side of the running or traveling fabric. This flow through the textile material and sucking-in, respectively, of the foam requires elaborate and expensive apparatus and an elevated power requirement.

In a method of the type mentioned initially hereinbefore which has been known from German Published Non-Prosecuted Application (DE-OS) No. 24 02 342, the foamed treatment liquor, after it has been applied to the planar textile structure but prior to the collapse or disintegration of the foam, is pressed and/or sucked by means of pressure or underpresser, respectively, through the material to be treated. According to the statements in the aforementioned German publication, part of the foam is destroyed when it is sucked through or sucked away, respectively, and the foam which has not disintegrated is removed.

In this heretofore known procedure, much more liquor to be foamed is required than the fibers of the planar textile structure to be treated can or should actually absorb. In this connection, reference is therefore, generally made to "excess application", which causes considerable losses of non-utilized auxiliary substances and/or dyes, great expense to drive out, for example, squeese out, the excess, as well as considerable drying costs and waste-water costs, among other things. An effort is made to apply, if possible, no more treatment medium, in whatever form, to the planar textile structure than the latter is actually able to absorb, if desired or necessary, prior to a subsequent fixation of the medium.

Such a method for achieving minimal application of treatment medium from the foam phase is described in German Published Prosecuted Application (DE-AS) No. 22 14 377 wherein, after application of the foam layer, disintegration of the foam is effected and, then, the substance which had been applied in the form of foam is fixed on the textile material. In the just-mentioned heretofore known disclusure, it is considered essential that the applied foam decays or disintegrates after a given period of time without flow-through, or mechanical sucking-in, respectively, of the foam into the textile material, either due to the composition of the foam itself or through supplying foam-destroying agents. The liquid content of the foam and the thickness of the applied foam layer can be utilized for respectively regulating or metering the amount applied and, thereby, for setting or adjusting the treatment intensity, such as the depth of color, for example, so that the minimal application of treatment medium can be achieved.

In the method known heretofore from the last-mentioned German Published Prosecuted Application (DE-AS) No. 22 14 377, the decay or disintegration of the foam caused by certain auxiliary chemical means within a given time after the application takes place, does not occur instantaneously but only after a given half-life. Ultimately, the decay or disintegration therefore remains incomplete. A further disadvantage of such a method is that possible variations in the combination of treatment media is limited by the supplying of the addition means respectively accelerating or triggering the decay or disintegration of the foam; for treatment of nap or crepe material and other bulky textile-fabric webs, this heretofore known method is suitable only with great reservations.

In German Published Non-Prosecuted Application (DE-OS) No. 28 08 949, a minimal application of foamed treatment medium is provided, however, the textile web which is to be treated does not come into contact, for practical purposes, with the foamed medium. Instead, it is transferred through the intermediary of an intervening support to the textile material. The intervening support is saturated by a foamed or liquid medium, squeezed and then brought into contact with the fabric being treated. Thus, even when the medium was originally foamed, only non-foamed moisture is transferred upon contact of the intervening support with the fabric.

In this last-mentioned German application, reference is made to a Swiss Patent (CH-PS) No. 535 074 in which a device is disclosed which cannot be operated with a greatly foamed medium because the foam congests or piles up in front of the medium applicator roller and can, accordingly, distribute non-uniformly over the textile web. This disadvantage is supposed to be overcome by the intervening support of the last-mentioned German application which is itself to be saturated with an excess of the medium and then squeezed to the desired quantity.

It is accordingly an object of the invention to provide a method of the type mentioned at the introduction hereto in which, without applying an excess of applied treatment liquor, i.e. with an absolute minimum application or even deficit application, and without the need for special chemical additives to effect the decay or disintegration of the foam, the liquid content of the foam, together with the thickness of the applied foam layer, can be used for regulating the applied quantity of foam and, therefore, for metering the treatment medium. The minimized application of treatment medium is defined by that amount of treatment medium which the fibers or other elements of the respective web of material can maximally absorb; the applied amount of treatment medium is thus sufficient for the provided treatment, and expensive driving-out, and especially squeezing-out, of a possible excess of treatment medium is unnecessary. With deficit application on the other hand, even less treatment medium is applied in such a manner that, depending upon the type of the fabric web, the individual elements thereof either receive less treatment medium than they can maximally absorb or are provided with treatment medium uniformly in an (outer) layer of greater or lesser thickness of the respective fabric web.

With the foregoing and other objects in view, there is provided, in accordance with the invention, a method for continuously treating, such as finishing and/or dyeing, planar testile structures through application of the respective treatment medium or liquor in foam form, which comprises subsequently applying underpressure to the planar structure at a magnitude at which the foam is destroyed completely without any appreciable flow through the material of the planar textile structure. The flow through the material is limited considerably beforehand by the air content of the planar structure and the foam, as well as by given leakages. On the other hand, the underpressure according to the invention should be strong enough so that it acts like a vacuum with respect to the initial pressure (approximately 1 bar abs) of the foam bubbles; the underpressure may be especially in the range between about 0.1 and 0.01 (abs). The invention can, therefore, also be described by saying that the foamed planar structure is passed through an underpressure space or chamber, the pressure of which is at least one order of magnitude smaller than the internal pressure of the foam bubbles. The respective underpressure space or chamber per se is described preferably as a squeeze gap extending over an area partially about the periphery of a cylinder drum.

In accordance with another mode of the method invention, the extent of penetration and impregnation, respectively, of the treatment medium with otherwise uniform distribution in the planar structure is predeterminable solely by the thickness of the foam layer which is applied (with suitable concentration of the treatment medium). If the planar structure, as preferred, is airtightly sealed on the surface coated with the foamed treatment medium i.e., on one side, and, supported by an air-permeable support layer, is subjected to the underpressure on the surface opposite the covering, a result, in accordance with a further mode of the method invention, when the pressure is low enough, for example, less than 0.1 bar (abs), is that the foam bubbles which have an internal pressure of about 1 bar (abs) will burst virtually instantaneously and completely, as in a vacuum, as the planar structure covered with the foam enters the underpressure chamber.

An essential feature of the invention is that virtually no suction effect with flow-through is exerted on the foam within the underpressure chamber wherein the foam is to be destroyed, among other things, and, thereby, a most minimal application is possible in spite of the underpressure treatment. If the planar structure on the surface coated with the foamed treatment medium is air-tightly covered up on one side and is subjected on the opposite surface to the underpressure which acts substantially like a vacuum on the foam bubbles while making contact with the air-permeable support layer, virtually no transport of the foam material takes place; rather, the foam bubbles expand until they burst.

It is just this mechanism which is essential for the invention. Because the underpressure namely acts not only on the foam but also on the airtight covering and presses the latter against a support layer and therefore against or towards the planar structure, the foam bubbles cannot expand in direction toward the airtight covering, but only unilaterally in direction toward the interior of the planar structure (until they burst) and thereby wet only the individual elements, especially fibers, of the web of material with predeterminable intensity. A result thereof is that, without actual material transport, the treatment medium which is applied to the planar structure in the form of foam with, for example, an average bubble size of 0.001 to 0.1 mm, penetrates completely uniformly from the coated side into the web of material until the applied foam is used up. If more foamed treatment medium were applied to the web of material than the fibers thereof could maximally absorb, the excess would be transported into the underpressure space or chamber. In the invention, it is just this which is undesired and superfluous, since the treatment medium, for example also dyes, can be distributed completely uniformly in the web of material without excess of treatment medium, if the method of the invention is applied.

Other features which are considered as characteristic for the invention are set forth in the appended claims.

Although the invention is illustrated and described herein as embodied in a method for continuously finishing and/or dyeing planar textile structures, it is nevertheless not intended to be limited to the details shown, since various modifications and structural changes may be made therein without departing from the spirit of the invention and within the scope and range of equivalents of the claims.

Figure 2:
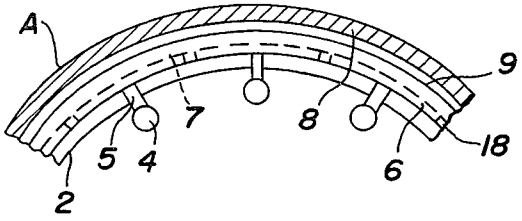

The construction and method of operation of the invention, however, together with additional objects and advantages thereof will be best understood from the following description of specific embodiments when read in connection with the accompanying drawings, in which:

FIG. 1 is a diagrammatic elevational view of apparatus for implementing the method of continuously finishing and/or dyeing planar textile structures in accordance with the invention; and FIG. 2 is an enlarged fragmentary sectional view of FIG. 1 showing the region A thereof.

Referring now to the drawing, there is shown in FIGS. 1 and 2, an embodiment of the apparatus for implementing the method according to the invention, which includes a cylinder shell or casing 1 formed with a multiplicity of holes 5 which can be connected, at the inner side 2 of the cylinder to an underpressure or negative pressure chamber or a non-illustrated vacuum pump by means of lines 4 which extend, for example, parallel to the cylinder axis 3, for generating an underpressure, a support layer 7 which evenly or uniformly distributes the underpressure on the cylinder surface 6; and an endless follower or backing cloth 8 which is air-impermeable and is pressed by the underpressure against the cylinder surface 6 or the support layer 7, respectively, the planar textile structure 9 which is to be treated being conducted between the backing cloth follower 8 and the support layer 7. The backing cloth follower 8 can run over rollers 10 and 11 on the one side and the surface 6 of the cylinder shell 1 on the other side. Advantageously, only those lines 4 for feeding the underpressure to the surface 6 of the cylinder shell 1 are connected to the non-illustrated vacuum pump or negative pressure source which is provided for acting upon the area of the cylinder surface 6 covered by the backing cloth follower 8, when the cylinder shell 1 revolves. According to FIG. 1, the sector of the cylinder shell periphery encompassed within the angles $\alpha+\beta$ would, under this regulation, not be subjected to the underpressure i.e. the lines 4 belonging to this sector of the cylinder periphery would have to be decoupled from the connection to the underpressure chamber or the vacuum pump by means of a revolving control head.

According to the illustrated embodiment, the planar textile structure 9 to be treated is introduced between the support layer 7 on the cylinder surface 6 and the backing cloth follower 8 as well as drawn over one of the rollers 11 and the roller 13 out of the apparatus for implementing the method according to the invention, for example, to a plaiting-down device.

It may be advantageous not to apply the foam provided for treating the planar structure 9, which may be a dyeing agent as well as some other treatment agent, directly to the planar structure 9 but first to the backing cloth follower 8, preferably in the vicinity of a roller 10. The foam can be applied to the backing cloth follower 8, for example, by means of a slit nozzle 15 extending parallel to the axis of the roller 10. A wiper or doctor 16 is then suitable for evenly or uniformly distributing the foam.

From the point of application at the wiper 16, the foam 17 travels together with the backing cloth follower 8 to the region at which the backing cloth follower 8 meets or runs together with the planar structure 9 at the surface 6 of the cylinder shell 1 and is transferred to the planar structure 9, respectively, during or after the running-together of the backing cloth follower 8 and the planar structure 9. Depending upon the choice of the thickness of the applied foam layer 17, a complete uniform treatment or a uniform treatment encompassing part of the layer thickness of the planar structure 9 can be obtained in the manner described hereinabove. The penetration of the foam 17 into the planar structure 9 results, in essence, from the fact that the foam 17, together with the planar structure 9, is brought into a vacuum having residual pressure which is so low that virtually instantaneous complete disintegration or destruction of all of the foam bubbles is ensured, at least until the planar structure 9 leaves the surface of the backing cloth follower 8. Because of the underpressure, the foam bubbles which have approximately normal pressure in the interior initially expand greatly, having no freedom of movement, however, in direction toward the impermeable backing cloth follower 8 but only in direction toward the interior of the planar structure 9 and, therefore, wetting the latter accordingly to a depth corresponding to the thickness of the foam layer which is applied.

Regardless of whether the foam is applied, in the method according to the invention, directly to the planar structure 9, or initially to the backing cloth follower 8, the danger exists that, in the region in which the backing cloth follower 8 joins or runs-together with the planar structure 9, the foam could be dammed or backed up. It may therefore be advantageous to connect the underpressure acting from the interior of the cylinder to the sector of the periphery of the cylinder shell 1 encompassed by the angle $\beta$ in FIG. 1 and not covered by the backing cloth follower 8, so that the foam which is to be applied or brought to the planar structure 9 or is already lying on it is attracted or drawn to the textile material aready in this region. Thereby, the foam can be prevented from damming or backing up in the aforementioned region.

The support layer 7 which is to be arranged advantageously directly on the surface 6 of the cylinder shell 1 has the purpose of achieving uniform distribution of the underpressure directly through the holes 5 to the surface 6 of the cylinder shell 1. This support layer 7 can be, for example, a wire screen fabric connected to the surface 6 by means of strips 18. The strips 18 should extend substantially parallel to the axis 3 of the cylinder shell 1 in order to prevent the development of a suction pull in peripheral direction of the cylinder.

There are claimed:

1. Method of continuously treating a planar textile structure by applying thereto a treatment medium in the form of foam which comprises applying the foam medium to a continuous air-impermeable surface and sandwiching the applied foam medium thereafter between the continuous air-impermeable surface and a surface of the planar textile structure, subsequently applying underpressure to the opposite surface of the planar textile structure at a magnitude at which the foam is completely destroyed without any appreciable flow through the material of the planar textile structure, the underpressure being applied to the planar textile structure by passing the latter through a chamber maintained at the underpressure, the magnitude of the underpressure being low when compared to the internal pressure of the bubbles of the foam so that the bubbles are completely destroyed without appreciable flow of the foam through the textile structure.

2. Method according to claim 1 which comprises varying the thickness of a layer of foam applied to the planar textile structures so as to predetermine the extent of penetration and flow of the treatment medium in the planar textile structures.

* * * * *